US011530069B2

(12) United States Patent
Dudlak

(10) Patent No.: US 11,530,069 B2
(45) Date of Patent: Dec. 20, 2022

(54) PAPERBOARD RETRACTABLE DISPENSER DEVICE

(71) Applicant: Econscience, Inc., Northbrook, IL (US)

(72) Inventor: Jonathan Dudlak, Wilmette, IL (US)

(73) Assignee: Econscience, Inc., Northbrook, IL (US)

( * ) Notice: Subject to any disclaimer, the term of this patent is extended or adjusted under 35 U.S.C. 154(b) by 179 days.

(21) Appl. No.: 16/994,126

(22) Filed: Aug. 14, 2020

(65) Prior Publication Data

US 2021/0292038 A1 Sep. 23, 2021
US 2022/0024631 A9 Jan. 27, 2022

Related U.S. Application Data

(60) Provisional application No. 62/991,199, filed on Mar. 18, 2020, provisional application No. 62/886,741, filed on Aug. 14, 2019.

(51) Int. Cl.

| | |
|---|---|
| ***B65D 3/04*** | (2006.01) |
| ***A45D 40/04*** | (2006.01) |
| ***B65D 3/28*** | (2006.01) |
| ***B65D 83/00*** | (2006.01) |

(52) U.S. Cl.
CPC ..... *B65D 3/04* (2013.01); *A45D 40/04* (2013.01); *B65D 3/28* (2013.01); *B65D 83/0016* (2013.01); *A45D 2200/05* (2013.01)

(58) Field of Classification Search
CPC ..... B65D 3/04; B65D 3/28; B65D 83/0016; B65D 83/0005; B65D 83/0011; B65D 83/0027; B65D 83/0022; A45D 40/04; A45D 2200/05
USPC ..... 222/390
See application file for complete search history.

(56) References Cited

U.S. PATENT DOCUMENTS 2,127,350 A * 8/1938 Davis ..... A45D 40/04 401/86
2,395,535 A * 2/1946 Crane ..... A45D 40/06 401/79
2,416,142 A * 2/1947 Bennett ..... B65D 3/04 138/140

(Continued)

FOREIGN PATENT DOCUMENTS

WO WO-9962771 A1 * 12/1999 ..... B65D 3/04
WO WO-2012135434 A1 * 10/2012 ..... A45D 34/04
WO WO-2012173462 A2 * 12/2012 ..... A45C 11/20

*Primary Examiner* — Paul R Durand
*Assistant Examiner* — Michael J. Melaragno
(74) *Attorney, Agent, or Firm* — K&L Gates LLP

(57) ABSTRACT

A retractable dispenser device includes: an externally threaded multi-ply tube comprising a spiral wound first multi-ply material, wherein the first multi-ply material includes one or more inner plies and an outer ply, wherein the outer ply is wider than the one or more inner plies, wherein subsequent windings of the inner plies abut each other such that the outer ply overlaps at each subsequent winding forming an external thread; and an internally threaded multi-ply sleeve comprising a spiral wound second multi-ply material, wherein the second multi-ply material includes an inner ply and one or more outer plies, wherein the inner ply is narrower than the one or more outer plies, wherein subsequent windings of the outer plies abut each other such that the inner ply leaves a gap at each subsequent winding forming an internal thread.

22 Claims, 5 Drawing Sheets

(56) References Cited

U.S. PATENT DOCUMENTS 2,431,156 A * 11/1947 Wonders ..... B43L 19/0012 15/433
3,555,976 A * 1/1971 Carter ..... B31C 3/04 493/276
3,907,441 A * 9/1975 Idee ..... A45D 40/04 401/175
5,143,259 A * 9/1992 Williams ..... B65D 83/75 222/389
5,639,175 A * 6/1997 Emoto ..... B31C 11/02 411/905
6,200,047 B1 * 3/2001 Holloway ..... A45D 40/04 401/86
6,227,733 B1 * 5/2001 Holloway ..... A45D 40/04 401/86
6,231,254 B1 * 5/2001 Holloway ..... A45D 40/04 401/86
6,637,964 B1 * 10/2003 Kuo ..... A45D 40/00 401/55
8,240,932 B1 * 8/2012 Perez-Espartero ..... B65D 83/0027 401/173
8,771,813 B2 * 7/2014 West ..... B65D 35/02 428/34.3
10,611,521 B1 * 4/2020 Piernot ..... B65D 3/28
2003/0102362 A1 * 6/2003 Hammond ..... B65D 3/22 229/93
2005/0098679 A1 * 5/2005 van de Camp ..... B32B 27/10 242/610.1
2008/0110922 A1 * 5/2008 Sines ..... B65D 83/0027 221/279
2010/0150972 A1 * 6/2010 West ..... B65D 35/14 510/400
2013/0011175 A1 * 1/2013 Hefetz ..... A45D 40/04 401/86
2014/0175131 A1 * 6/2014 Abrams ..... B65D 83/0005 222/405
2014/0197171 A1 * 7/2014 Taylor ..... B65D 83/0027 220/288
2014/0219704 A1 * 8/2014 Huang ..... A45D 40/12 401/74
2015/0014365 A1 * 1/2015 Smith ..... B65D 83/0027 222/390
2015/0151896 A1 * 6/2015 Jethwani ..... B65D 47/06 222/1
2015/0353265 A1 * 12/2015 Jethwani ..... B65D 83/005 222/328
2020/0283221 A1 * 9/2020 Zhang ..... B65D 1/40

* cited by examiner

PAPERBOARD RETRACTABLE DISPENSER DEVICE

CROSS-REFERENCE TO RELATED APPLICATIONS

This application claims the benefit of U.S. Provisional Application No. 62/991,199 filed on Mar. 18, 2020, and U.S. Provisional Application No. 62/886,741 filed on Aug. 14, 2019, the entireties of which are incorporated herein by reference.

BACKGROUND OF THE INVENTION

The present subject matter relates generally to environmentally friendly retractable dispenser devices for consumable goods. Specifically, the present subject matter provides a paperboard retractable dispenser device for consumable goods, as well as systems and methods for manufacturing the dispenser.

Non-durable plastic goods are commonly used in connection with disposable and short lifecycle products that are typically sold in very high volume. The manufacturing, use, and disposal of these non-durable plastic goods is destructive to the environment. Accordingly, there is a strong need to replace these products with sustainable alternatives that are recyclable, compostable, and/or readily biodegradable.

The traditional twist-up plastic dispenser (most often associated with lip balm) is especially problematic to the environment. The bulk of the products that lend themselves to this traditional twist-up dispensing format tend to be found in the cosmetics and personal-care markets. These products include the aforementioned lip and skin balm and salve, solid perfume, deodorant, sunscreen, topical homeopathic treatments, and a host of other products, very often products that are applied to the skin. Other industries use the twist-up dispensing format for dispensing and applying wax and/or oil-based solids to surfaces, for example, wax-based leather treatments for clothing and shoes, industrial lubricants for polishing, cutting and cooling, etc.

Lip balm is a billion-dollar industry worldwide that results in hundreds of millions of plastic dispenser tubes being introduced into the waste stream each year. The dispenser tubes are difficult to recycle as they are extremely small and, as a result, often end up as landfill waste. These dispenser tubes typically do not degrade and instead remain intact, or as microplastic residue, in waterways, natural environments, and landfills.

Creating a viable alternative to the conventional plastic twist-up dispenser from more Earth-friendly materials has proven difficult. The "twist-to-dispense" plastic mechanism with which consumers have become familiar is challenging to mimic without the use of molded resins and the cost to produce the existing plastic packages is extremely low (though requires one to ignore the actual environmental costs). But with the need to phase out disposable plastics to better preserve our natural environments, there is a need for an environmentally friendly dispensing device.

BRIEF SUMMARY OF THE INVENTION

The present disclosure provides an environmentally friendly product dispenser that can be used as a replacement for the conventional plastic twist-up dispenser. Specifically, the present subject matter provides a paperboard twist-up dispenser for consumable goods, as well as systems and methods for manufacturing the dispenser.

The paperboard twist-up dispenser can be made using wound paper tubing configured in various mechanical advance/retract constructions. In a first example, one or more sizes of paper tubes that slide relative to each other is used to provide the dispensing and retracting of a solid or semi-solid product stored within the dispenser in a push/pull design.

In another example, a durable thread is created on an exterior surface of a smaller diameter paper tube (e.g., tube) housed within a larger diameter paper tube (e.g., sleeve). In this embodiment, the outer diameter of the smaller tube is approximately equivalent to, though slightly smaller than, the inner diameter of the larger tube and the two tubes mate such that rotational motion applied to the tube translates to axial motion of the tube within the sleeve, causing the product stored within the sleeve to move along the length of the device, again to provide the dispensing and retracting of a solid or semi-solid product stored within the dispenser.

In both examples provided above, a user can mechanically raise and lower an inner tube in and out of an outer tube to dispense a product from the device. The inner tube is generally referred to herein as a tube and the outer tube is referred to as a sleeve. It is contemplated that the tube can be fitted with a flat, raised, or recessed support surface that can be made from a paper or other compostable or biodegradable material upon which the material to be dispensed is supported. Alternatively, the surface on which the material is supported may be a separate component (i.e., stem) housed within the tube. A solidified product can be positioned on the top surface of the stem wherein, when the dispensing mechanism is engaged, the product can extend and retract from the outer sleeve.

In both the push/pull design and the threaded/twist design described above, the exterior surface of the sleeve may be housed within an even larger third tube (e.g., base) and a removable paper cap may be provided to close off the top of the base. For example, the cap and base may be of like diameter to provide a well-finished dispensing package. The dispensing device can then be opened, closed, dispensed, and retracted at will. The dispensing device also maintains a consistent overall length when closed, secures the product position within the sleeve, and prevents unwanted movement of the dispensing mechanism until the user intentionally and actively engages the mechanism to dispense the product, which is important for between-use storage in a bag, pocket, etc.

In the primary embodiment of the product dispenser disclosed herein, the tube and the sleeve comprise externally and internally threaded multi-layer (i.e., multi-ply) paper tubes. The threading on each tube is created by the relationship of the widths of each ply used in constructing each tube. As the multi-ply paper composition is wrapped around a mandrel, at least one of the plies may be wider or narrower to form the threading.

In other words, each component (e.g., sleeve and tube) can be made using a multi-ply paper substrate in which one or more plies are equal to the basis width, which is roughly equivalent to the width of the winding belt. Importantly, each multi-ply paper substrate must include at least a single paper ply that is larger than the basis width (for creating the male thread) or narrower than the basis width (for creating the female thread). The width of the plies used to create the male and female threading can be chosen such that their proportions compensate for the thickness of the paper and enable the male threading to fit into the female threading.

In a specific example, an internally threaded paper tube is created by using a narrower bottom layer in a multi-ply construction to create a gap that forms the interior female thread. For example, a sleeve having an internally threaded surface may be created using a four-ply construction in which the bottom ply is a narrower width than the three outer plies. In one example of such a construction, PLY 1 is the bottom (most interior) ply and the PLY 2, PLY 3, and PLY 4 are the outer plies. In this example, PLY 1 may be 0.67" wide, while PLY 2, PLY 3, and PLY 4 are each 0.75" wide. Winding the bottom ply (0.67" wide) at the same pitch as each of the top plies (each 0.75" wide) so that subsequent windings abut without overlap creates an approximately 0.1" gap on the inside surface of the finished tube. The narrower-than-basis-width paper on the bottom ply of the sleeve component creates a groove along the inner diameter where the paper underlaps itself, forming a sleeve with an interior female thread.

The depth of the interior female thread is a function of the thickness of the bottom ply. Using the example in the preceding paragraph, PLY 1 and PLY 2 may each be 0.014" thick and PLY 3 and PLY 4 may each be 0.008" thick. In such an example, the interior female thread would be 0.014" deep.

In a specific example, an externally threaded paper tube is created by using a wider top layer in a multi-ply construction to create an overlap that forms the exterior male thread. For example, a sleeve having an externally threaded surface may be created using a three-ply construction in which the top ply is wider than the two inner plies. In one example of such a construction, PLY 1 and PLY 2 are the inner plies and the PLY 3 is the top ply. In this example, PLY 1 and PLY 2 may each be 0.75" wide, while PLY 3 is 0.85" wide. Winding the top ply (0.85" wide) at the same pitch as each of the bottom two plies (each 0.75" wide) so that subsequent windings abut without overlap creates an approximately 0.1" overlap on the outside surface of the finished tube. The wider-than-basis-width paper on the top ply of the tube component creates a raised ridge along the outer diameter where the paper overlaps itself, forming a tube with an exterior male thread.

The height of the exterior male thread is a function of the thickness of the top ply. Using the example in the preceding paragraph, PLY 1 and PLY 2 may each be 0.008" thick and PLY 3 may be 0.014" thick. In such an example, the exterior male thread would be 0.014" high.

In order to facilitate cooperation between the sleeve and tube components, each must be wound such that the resulting thread pitch matches between the two components. Further, in each example, the winding mandrel about which the tubes are wound determines the inner diameter of each tube.

Although the example used above provides a four-ply sleeve and a three-ply tube, either component may be formed using any number of layers that includes at least two or more plies. In other words, the technique provided herein works as long as more than a single ply is used to form each tube. For example, either or both of the tube and sleeve may be made from a two-ply construction. In another example, either the tube or sleeve may be made from a six-ply construction.

Using the process described above, the resulting tube includes threads that are a solid substrate, which cannot be easily collapsed or worn down over time during use. Properly constructed, the threads fit effortlessly into the sleeve which includes a consistent, hard-edge channel (created by the thickness of the bottom paper ply itself) to promote solid tracking and low-friction turning. The thicker the thread-creation plies are, the deeper the threads can engage with the plies, which results in a more robust mechanism. Further, the closeness in size of the contact diameters of each tube component (i.e., sleeve and tube) can be less critical, as a thicker ply affords more thread mating depth by design. It is contemplated that a paper caliper for the ply can be 0.012-0.016 inches to create significant thread thickness without imparting excess rigidity or spring-back in the ply as the tube is spirally wound, which makes adhesion more difficult and can result in "checking" or minute folds and breaks in the surface of the paper.

The components may be formed with a smooth surface on the non-threaded face of each tube (e.g., the interior surface of the tube and the exterior surface of the sleeve) and with minimal ply gap.

The description of the subject matter provided herein can be framed as providing two sets of components: (1) the mechanism, i.e., the tube, stem/support, and sleeve that form the internal workings of the dispensing mechanism responsible for advancing and retracting the material housed within the device; and (2) the housing including a base and cap that serve as finished case for the mechanism.

The manufacturing process of the device includes three main processes: (1) spiral winding a substrate to produce one or more of the individual components; (2) performing the required finishing operations on each component; and (3) assembling the finished components into a functioning dispenser package.

A wide range of substrates can be used to produce these components. However, it is understood that the descriptions provided herein are particularly well-suited for creating a mechanism made from a paper or similar fiber substrate. For practical purposes, it is useful to use a substrate material that allows the product dispensed from the device to be contained and dispensed (and ideally, but not necessarily, filled into the package in a liquid state) without significant adhesion between the product and tube wall. Such adhesion may adversely impact the dispensing of the product or inhibit the smooth movement of the tube within the sleeve. Ideally, the substrate used has a high resistance to grease, oil, and wax (typically measured and conveyed as a numerical "kit" value by a paper mill) to be compatible with the widest range of products, thereby reducing the risk of the product binding to the paper substrate used to create the sleeve.

Example of the processes taught to form internally and externally threaded tubes are provided above. In addition to the core teachings of varying the widths of the plies within the multi-ply substrates as described to form the threading, the manufacturing process should also take into consideration proper clearances and thread engagement between the mechanical components of the device. This includes controlling the size of the winding mandrels that determine the internal diameter of the sleeve and tube, as well as controlling the caliper of each substrate ply that makes up the respective finished wall thicknesses of the sleeve and tube. For example, the difference between the outside diameter of the tube and the internal diameter of the sleeve may be small to promote engagement while requiring minimal input force to operate the mechanism. For example, a 0.003-0.007 inches differential has been shown to be particularly advantageous to allow for manufacturing variation, and shrinkage and expansion with changes in relative humidity, for a paper-based substrate.

Controlling the slit width and cut width tolerance of the paper substrate to be put across the spiral winder to build the tube walls can help to ensure the threads on the tube and sleeve have a nearly identical pitch, which is particularly important as any significant pitch discrepancy between the two parts can cause the mechanism to bind and not move smoothly. The "basis width," or the width of the paper upon which the spiral winder's belt angle is set to result in minimal ply gap for the body of the tube of the tube and sleeve, can be the same for both the tube and the sleeve.

Although primarily described above with respect to the use of an overlapping and underlapping winding process, the threads of the sleeve and tube can be created by any method capable of producing engagement between the two components.

In the primary example provided herein, the production method builds up a threaded section of a first component along a narrow, spiraling path to mate into a groove or depression of similar width and depth on the companion component. For example, an inner surface of the sleeve is formed with female threads (i.e., a continuous spiral groove) that receive male threads (i.e., a continuous raised spiral formation) on the outer surface of the tube.

Although the primary manufacturing methods cost-effectively enable the threading to be created in-line by the spiral winding process, alternatively the threads can be added in a secondary process, if deemed preferable. In an example, the threading can be formed by embossing a channel into one component part (e.g., sleeve) and debossing a cooperating ridge one into the companion component part (e.g., tube). This can be done, for example, as the substrate spirally winds across the forming mandrels to form each tube.

In some examples of the dispenser, a support platform is provided within the tube to provide a solid platform upon which the product to be housed and dispensed can sit.

In other examples of the dispenser, a stem component provides a solid platform upon which the product to be housed and dispensed can sit and a flared bottom that creates a vertical stop for advancing the product and provides a surface that easily mates to the interior of the base in final assembly.

The support platform or stem can be fitted into the tube in a slightly recessed position to allow the product to flow into or sit in the resulting chamber. The top edge of the tube can be formed to slightly decrease the diameter at this edge, creating a lip that can ultimately hold onto the product during retraction.

To provide optimal performance, the gap between the support platform or the stem and the interior of tube should be minimized. For example, when a liquid product is poured into the chamber at fulfillment, any gaps would allow the product to flow beyond the platform ledge and onto the lower portion of the base chamber, potentially inhibiting performance and causing product loss.

In an example, the sleeve can have its bottom edge formed inward by a small degree to create a bottom "stop" for the tube component, either before or after being mated to the tube. The mating can be performed manually, with the interior ply gap of the sleeve mated to the exterior threads of the tube and inserted sufficiently (or mated by pushing in directly in the push/pull design example) to maintain engagement of the components together prior to further assembly. The stem can then be inserted inside the tube component, and finally the entire assembly inserted into the base. Holding can be achieved with glue, friction, or any reasonable method that can maintain the components in their proper orientations throughout use.

Like the tube and the sleeve, the stem, base, and cap may also be formed using a paper-based substrate. Although very critical to the proper formation of the tube and the sleeve, the setup of the spiral winding for the stem, base, and cap components can be significantly less critical, as these components do not form the threading. For example, the cap can merely provide a way to enclose the product contained within and create a clean exterior presentation.

The stem, base, and cap can include a curl-and-disc operation to create a solid top platform, bottom or top, respectively. In such a process, the bottom edge of the base or top edge of the cap tube can be "curled" inward using a die, wherein the last ~¼" of the edge of the tube is rolled from the outside diameter toward the tube interior, creating an interior ledge upon which a solid end stop can rest. The end stop can be a flat circle of paper and can be fitted (with friction or glued in place) and form a functional closure on one end. Once the curl-and-disc operation is performed on the cap, the cap can be finished and can be put aside for inclusion with the rest of the package to be fitted by the fulfillment contractor after the product is filled.

The base can be formed in a configuration with cutouts or "windows," through which the tube can be grasped by the user, to reduce the number of components in the assembly.

In some embodiments, the dispenser can maintain a consistent overall package length regardless of tube position, wherein a portion of the base can be removed in finishing to create two finger holes, or windows, that allow access to the tube inside. The base can employ a tube wall thickness to maintain structural integrity of the package after the material is removed, for example, 0.030-0.050 inches.

The pair of "windows" in the base tube circumference can be positioned roughly 0.2-0.5 inches from the top of the base tube's open end to allow a portion of the full wall of material of the base near the upper edge to be later affixed to the sleeve portion of the interior mechanism, while affording access to the tube that can reside inside at a height as high as possible within the base and permit all of the product to be dispensed. The windows can be a width and height to allow the consumer to reasonably grasp the tube at two points that are 180 degrees apart and turn slightly to index the tube upward and downward, while leaving enough material between the cutouts to hold the portions of the base above and below together. The pair of windows can most easily be created using cutting dies, whether rotary, steel-ruled or through-punch type, or a frictional cutting apparatus such as a laser or waterjet and incorporated as a station in a multi-operation machine or performed as a standalone process.

During use, the tube is secured to the stem, which is in turn secured to the base. The sleeve moves in and out of the base as product is extended or retracted. More specifically, the tube, stem, and base are secured together and the external threading of the tube engages internal threading of the sleeve along a lower half thereof in an initial starting position. Product is filled into the sleeve and tube. As product is used, the user rotates the sleeve about the tube, sliding the sleeve gradually into the base and shifting the tube into an upper half of the sleeve. The stem may be adhered into the bottom of the base using techniques such gluing, taping, fastening, etc.

The assembled components form a package that is ready for filling with liquid or pre-formed solid product and stays in the retracted position until opened by the end user.

In a first example, a retractable dispenser device includes: an externally threaded multi-ply tube comprising a spiral wound first multi-ply material, wherein the first multi-ply material includes one or more inner plies and an outer ply, wherein the outer ply is wider than the one or more inner plies, wherein subsequent windings of the inner plies abut each other such that the outer ply overlaps at each subsequent winding forming an external thread whose width is determined by the difference in width between the one or more inner plies and the outer ply and whose height is determined by the thickness of the outer ply; and an internally threaded multi-ply sleeve comprising a spiral wound second multi-ply material, wherein the second multi-ply material includes an inner ply and one or more outer plies, wherein the inner ply is narrower than the one or more outer plies, wherein subsequent windings of the outer plies abut each other such that the inner ply leaves a gap at each subsequent winding forming an internal thread whose width is determined the difference in width between the one or more outer plies and the inner ply and whose depth is determined by the thickness of the inner ply; wherein the tube and the sleeve are each wound at a consistent angle to form a cooperating thread pitch.

The first multi-ply material and/or the second multi-ply materials may comprise a paperboard material. A stem or other support surface may be located within the tube. The stem may be affixed to the tube. A base may be affixed to the stem. The base may include two or more windows providing tactile access to the tube, such that a user may twist the tube within the base to advance and retract the product housed within. Twisting the tube in a first rotational direction advances a material supported on the stem in a first axial direction relative to the sleeve and twisting the tube in a second rotational direction opposite the first rotational direction advances the material supported on the step in a second axial direction relative to the sleeve, wherein the second axial direction is opposite the first axial direction. A removeable cap may cooperate with the base to enclose the tube and sleeve in an appropriate housing.

An example of a method of forming an internally threaded tube and a corresponding externally threaded tube includes the steps of: spirally winding a first multi-ply material to form an externally threaded multi-ply tube, wherein the first multi-ply material includes one or more inner plies and an outer ply, wherein the outer ply is wider than the one or more inner plies, wherein subsequent windings of the inner plies abut each other such that the outer ply overlaps at each subsequent winding forming an external thread whose width is determined by the difference in width between the one or more inner plies and the outer ply and whose height is determined by the thickness of the outer ply; and spirally winding a second multi-ply material to form an internally threaded multi-ply sleeve, wherein the second multi-ply material includes an inner ply and one or more outer plies, wherein the inner ply is narrower than the one or more outer plies, wherein subsequent windings of the outer plies abut each other such that the inner ply leaves a gap at each subsequent winding forming an internal thread whose width is determined by the difference in width between the inner ply and the one or more outer plies and whose depth is determined by the thickness of the inner ply; wherein the tube and the sleeve are each wound at a consistent angle to form a cooperating thread pitch.

The first multi-ply material and/or the second multi-ply materials may comprise a paperboard material. To optimally allow for manufacturing variation, and shrinkage and expansion with changes in relative humidity for a paper-based substrate, the difference between an exterior diameter of the tube and an internal diameter of the sleeve may be in the range of 0.003-0.007 inches. The top edge of the tube may be formed inward to create a lip that can grasp the product. The bottom edge of the sleeve may be formed inward to create a tube stop.

An advantage of the present device is providing a compostable and/or readily biodegradable dispensing device for application products.

A further advantage of the present system is providing a durable twisting or push/pull dispensing device with structural integrity that is made of paper material.

Another advantage of the present system is providing a production-efficient design that is competitive with plastic analogues.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

The present disclosure provides an environmentally friendly product dispenser. Examples of the various elements of the dispensing mechanism are described below with reference to the Figures.

Figure 1A:
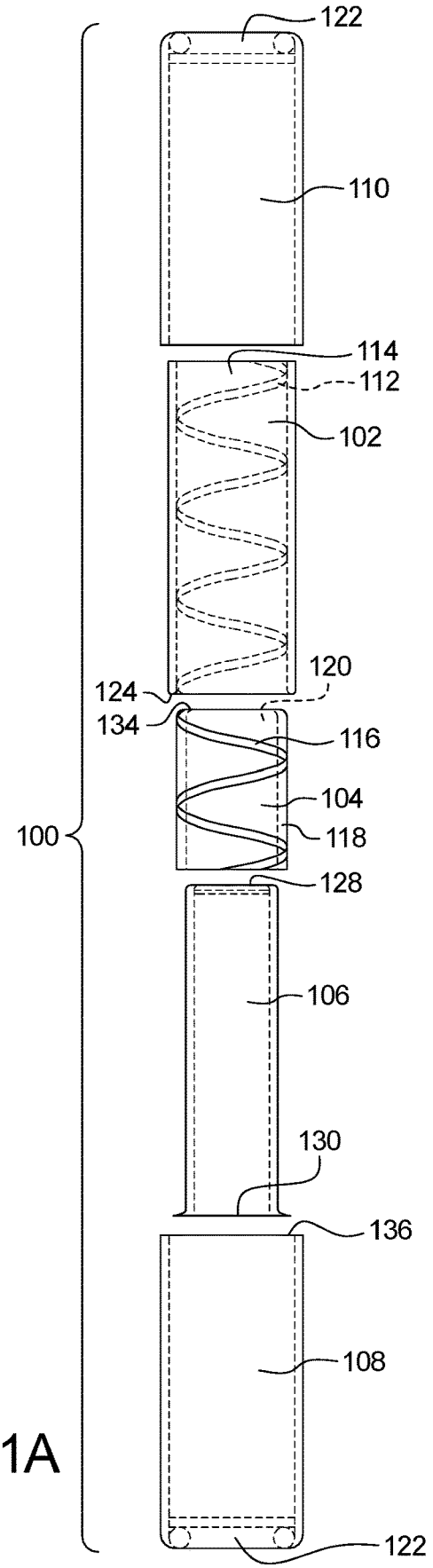
FIG. 1*a* is an exploded cross-sectional view of an example of a retractable paperboard dispenser device using a twist-up dispensing mechanism.

FIG. 1*a* illustrates an example of a retractable paperboard dispenser 100 according to the present disclosure using a twist/turn dispensing mechanism. As shown in FIG. 1*a*, the dispensing mechanism 100 may include a sleeve 102, a tube 104, a stem 106, a base 108, and a cap 110. The tube 104 slides relative to the sleeve 102 slides to provide the dispensing and retracting of a solid or semi-solid product stored within the dispensing mechanism. In an embodiment, the inner diameter of the sleeve 102 is approximately equivalent to, though slightly larger than, the outer diameter of the tube 104. In this embodiment the sleeve 102 and tube 104 mate such that rotational motion applied to the tube 104 translates to axial motion of the tube 104 within the sleeve 102, causing the product stored within the sleeve 102 to move along the length of the device 100. The motion of the tube 104 within the sleeve 102 may, for example, provide for the dispensing and retracting of the product stored within the dispenser. In an embodiment, the product may be a solid or semi-solid product. In some embodiments, the tube 104 may be affixed to the stem 106 and the stem 106 may be affixed to the base 108.

In the embodiment shown in FIG. 1*a*, the sleeve 102 includes a durable thread 112 on an interior surface 114 of the sleeve 102. In such an embodiment, tube 104 also includes a durable thread 116 on an exterior surface 118 thereof. The durable threads 112, 116 may be multi-layer (i.e., multi-ply) paper tubes as described below with reference to FIGS. 4 and 5. The threading 112, 116 on the tube 104 and sleeve 102 is created by the relationship of the widths of each ply used in constructing the tube 104 and sleeve 102 as well be described in more detail later.

In an embodiment, an interior 120 of the tube 104 can be fitted with a flat, raised, or recessed support surface that can be made from a paper or other compostable or biodegradable material upon which the product to be dispensed is supported. Alternatively, the product may be supported by the stem 106. For example, the stem 106 can be housed within the tube 104. In this example, the product can be positioned on the top surface of the stem 106 wherein, during operation of the device 100, the product can extend and retract from the sleeve 102.

The exterior surface of the sleeve 102 may be housed within an even larger base 108. Additionally, a removable cap 110 may be provided to close off the top of the base 108. It is contemplated that the cap can be constructed of paper. In an example, the cap 110 and base 108 may be of like diameter to provide a well-finished dispensing package. The dispensing device 1 can then be opened, closed, dispensed, and retracted.

In an embodiment, the bottom of the stem 106 may be flattened out to fit close to the inner diameter of the base 108. As an example, the cap 110 and base 108 may employ a curl and disc top 122. It is further contemplated the bottom 124 of the sleeve 102 may be curled inwardly to prevent the tube 104 moving past the bottom 124 of the sleeve 102 during use. In an embodiment, the top of the tube 104 may be curled in to catch the bottom of the product after the product is poured or inserted in to facilitate retraction.

Figure 1B:
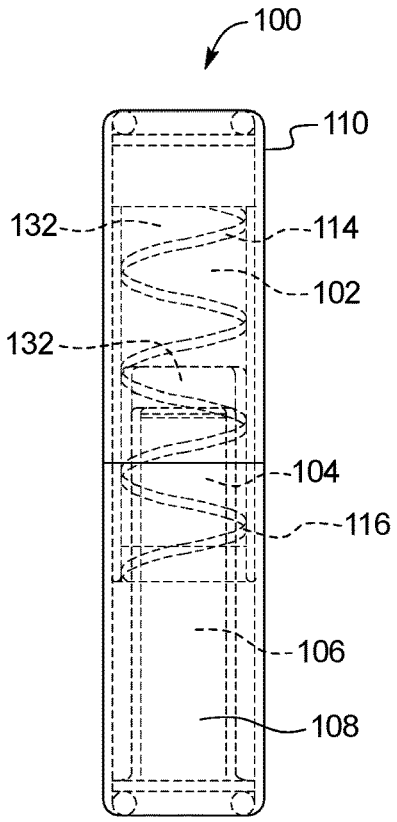
FIG. 1*b* is an assembled cross-sectional view of the retractable paperboard dispenser device using a twist-up dispensing mechanism.

In one embodiment, a support platform may be provided within the tube 104 to provide a solid surface upon which the product can be housed and dispensed. In another example, the stem 106 provides a solid surface 128 upon which the product to be housed and dispensed can sit and a flared bottom 130 creates a vertical stop for advancing the product through the sleeve 102 and easily mates to the interior of the base 108 in final assembly as shown in FIG. 1*b*.

The support platform or stem 106 can be fit into the tube 104 in a slightly recessed position to allow the product to flow into or sit in the resulting chamber 132. The top edge 134 of the tube 104 can be formed with a slightly narrowing diameter, creating a lip that can ultimately hold onto the product during retraction.

To provide optimal performance, the gap between the support platform or the stem 106 and the interior of tube 104 should be minimized. For example, when a product is poured into the chamber at fulfillment, any gaps would allow the product to flow beyond the platform ledge and into the base 108, potentially inhibiting performance and causing product loss.

In an example, the bottom edge 124 of the sleeve 102 can be formed with a slightly smaller diameter to create a bottom "stop" for the tube 104 in the assembled position. The mating can be performed manually, with the interior ply 112 gap of the sleeve 102 mated to the exterior threads 116 of the tube 104 and inserted sufficiently (or mated by pushing in directly in the push/pull design example) to maintain engagement of the components together prior to further assembly. The stem 106 can then be inserted inside the tube 104 component, and finally the entire assembly inserted into the base 108. Holding can be achieved with glue, friction, or any reasonable method that can maintain the components in their proper orientations throughout use.

Like the tube 104 and the sleeve 102 components, the stem 106, the base 108, and the cap 110 may also be formed using a paper-based substrate. In one embodiment, the base 108 comprises a wall thickness to maintain structural integrity of the dispenser 1. For example, the tube wall thickness may be 0.030-0.050 inches. The base 108 can be short enough to prevent the tube 104 from retracting beyond its thread engagement with the sleeve 102.

During use, the tube 104 is secured to the stem 106, which is in turn secured to the base 108. The sleeve 102 moves in and out of the base 108 as product is extended or retracted. More specifically, the tube 104, stem 106, and base 108 are secured together and the external threading 116 of the tube 104 engages internal threading 112 of the sleeve 102 along a lower half thereof in an initial starting position. Product is filled into the sleeve 102 and tube 104. As product is used, the user rotates the sleeve 102 about the tube 104, sliding the sleeve 102 gradually into the base 108 and shifting the tube 104 into an upper half of the sleeve 102. The stem 106 may be adhered into the bottom of the base 108 using techniques such gluing, taping, fastening, etc.

FIG. 1*b* is an example of the dispensing device of FIG. 1*a* in closed position. As shown in FIG. 1*b*, the dispensing device 100 may maintain a consistent overall length when closed. In particular, the base 108 and the cap 110 secure the product position within the sleeve 102, and prevent unwanted movement of the dispensing mechanism until the user intentionally and actively engages the mechanism to dispense the product.

The stem 106, base 108, and cap 110 may be formed using a paper-based substrate. The stem 106, base 108, and cap 110 can include a curl-and-disc operation to create a solid top platform, bottom or top, respectively. In such a process, the bottom edge of the base or top edge of the cap 110 can be "curled" inward using a die. For example, the last ~¼" of the edge of the tube 104 is rolled from the outside diameter toward the tube interior, creating an interior ledge upon which a solid end stop can rest. The end stop can be a flat circle of paper and can be fitted (with friction or glued in place) and form a functional closure on one end.

Figure 2A:
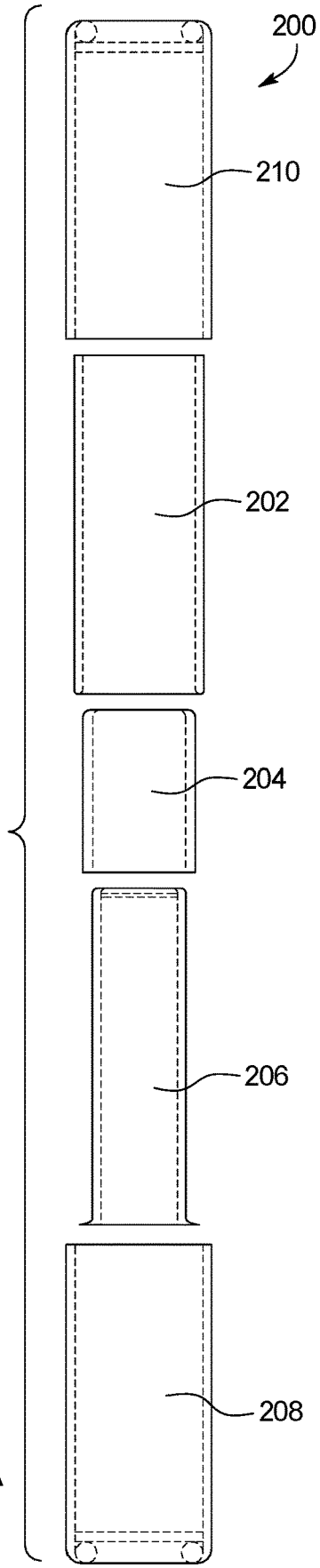
FIG. 2*a* is an exploded cross-sectional view of an example of a retractable paperboard dispenser device using a push/pull dispensing mechanism.

FIG. 2*a* illustrates an embodiment of the dispensing device 200 using a push/pull dispensing mechanism. As shown in FIG. 2*a*, the dispensing mechanism 200 includes a sleeve 202, tube 204, stem 206, base 208, and cap 210. The sleeve 202 slides relative to the tube 204 to provide the dispensing and retracting of a solid or semi-solid product stored within the dispensing mechanism 200. In some embodiments, the inner diameter of the sleeve 202 is approximately equivalent to, though slightly larger than, the outer diameter of the tube 204.

Figure 2B:
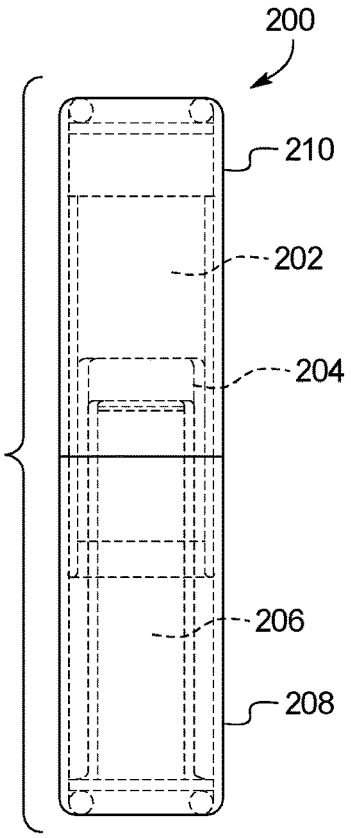
FIG. 2*b* is an assembled cross-sectional view of the retractable paperboard dispenser device using a push/pull dispensing mechanism shown in FIGS. 1*a* and 1*b*.

FIG. 2*b* is an example of the dispensing device of FIG. 2*a* in closed position. The cap 210 may provide a way to enclose the product contained within and create a clean exterior presentation.

Figure 3A:
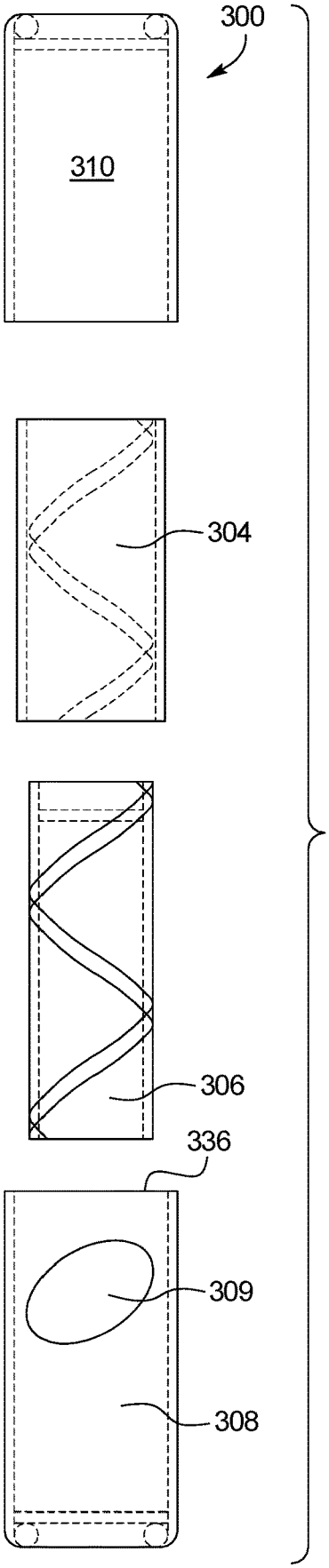
FIG. 3*a* is an exploded cross-sectional view of another example of a retractable paperboard dispenser device using a twist-up dispensing mechanism.
Figure 3B:
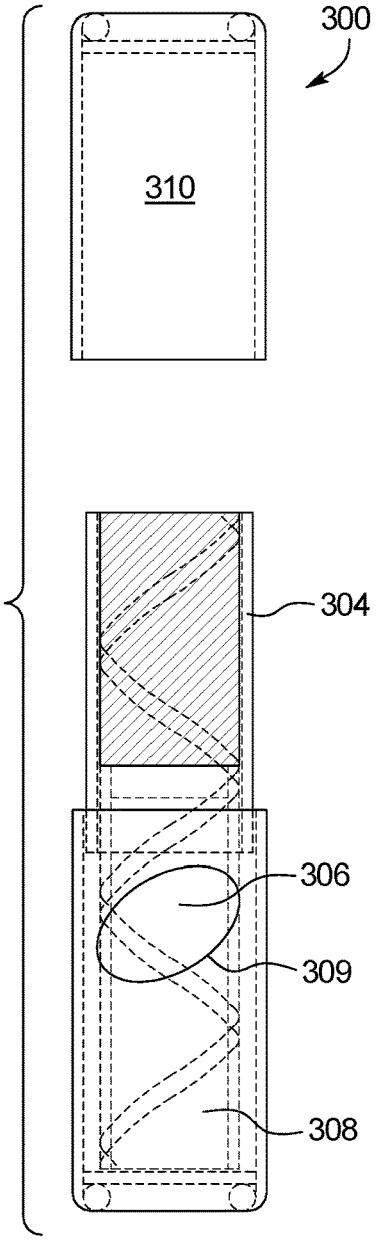
FIG. 3*b* is an assembled cross-sectional view of the retractable paperboard dispenser device using a twist-up dispensing mechanism shown in FIG. 3*a*, with the cap removed.

A further embodiment of the dispensing device 300 is provided in FIGS. 3*a* and 3*b*. The base 308 can be formed in a configuration with cutouts 309 or "windows," through which the tube 306 can be grasped by the user, to reduce the number of components in the assembly. For example, the base 308 may comprise a pair of cutouts 309. The pair of cutouts 309 in the circumference of the base 308 can be positioned roughly 0.2-0.5 inches from the top of the open end 336 of base 308 to allow a portion of the full wall of material of the base near the upper edge 336 to be later affixed to the sleeve 304, while affording access to the tube 306 that can reside inside at a height as high as possible within the base 308 and permit all of the product to be dispensed.

For example, the cutouts 309 can be a width and height to allow the consumer to reasonably grasp the tube 306 at two points that are approximately 180 degrees apart and turn slightly to index the tube 306 upward and downward, while leaving enough material between the cutouts 309 to hold the portions of the base 308 above and below together. The one or more cutouts 309 can be created, for example, using cutting dies. For example, a rotary, steel-ruled or through-punch type cutting die may be used. In an example, a frictional cutting apparatus such as a laser or waterjet may be used. The cutting apparatus may be incorporated as a station in a multi-operation machine or performed as a standalone process.

In some embodiments, the dispenser 300 can maintain a consistent overall length regardless of the position of the tube 304. For example, when a portion of the base 308 is removed in finishing to create two windows 309 that provide access to the tube 306.

Figure 4:
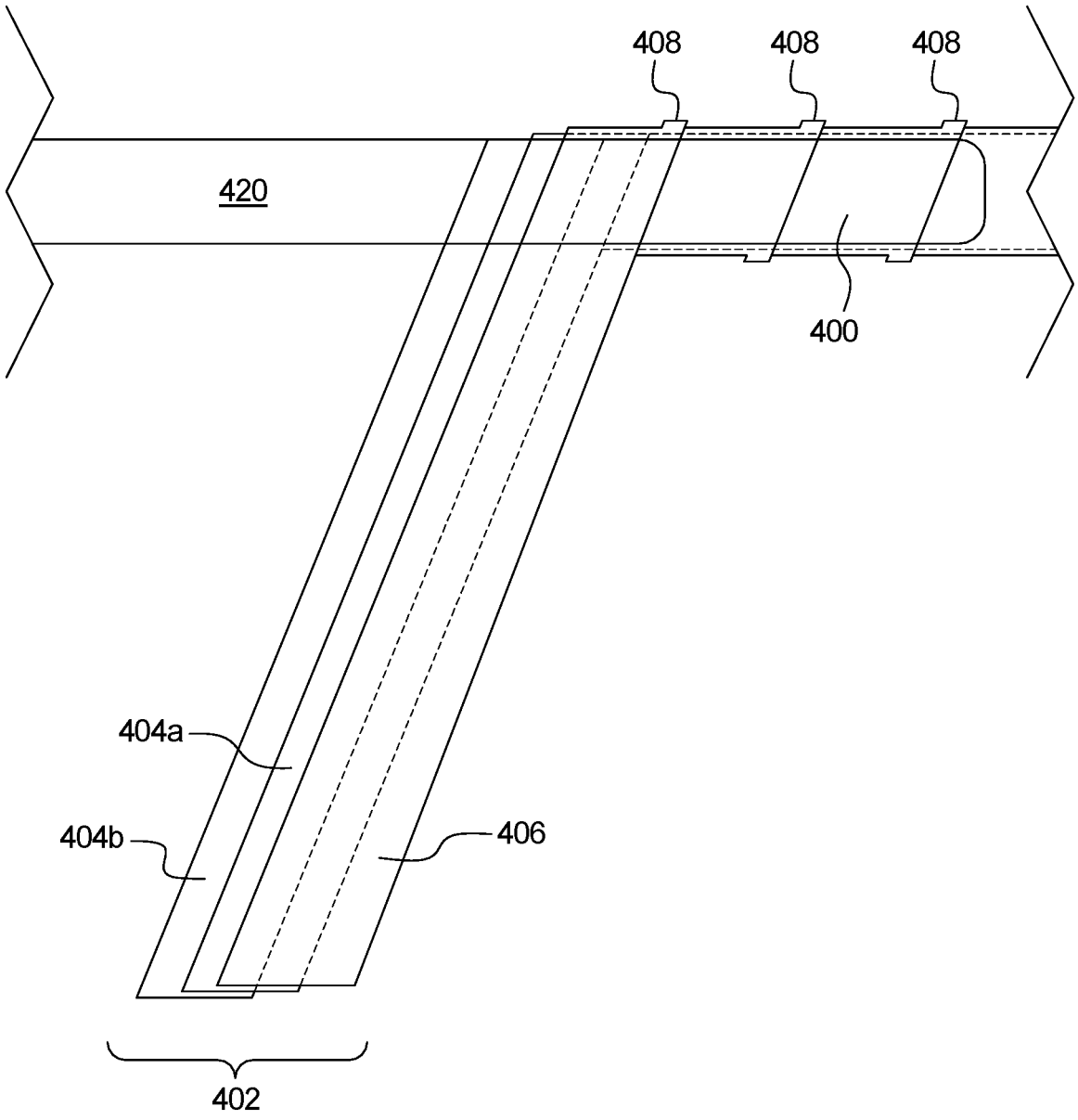
FIG. 4 is an illustration of a process for making an outer threaded tube by winding a multi-ply paperboard structure around a mandrel.
Figure 5:
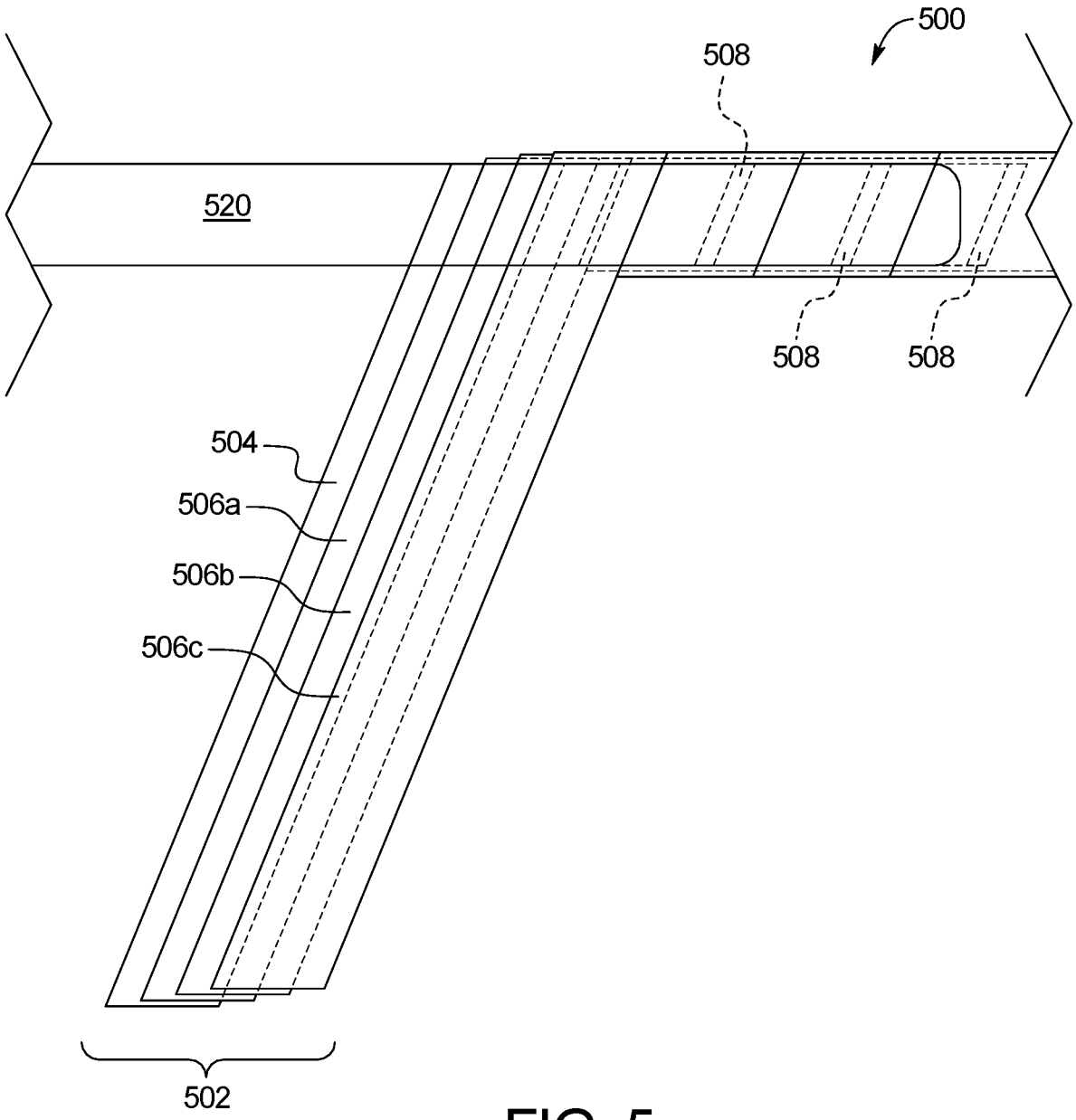
FIG. 5 is an illustration of a process for making an inner threaded sleeve by winding a multi-ply paperboard structure around a mandrel.

Referring to FIGS. 4 and 5, a process for making the device 100 disclosed herein is also described. In particular, the manufacturing process of the device includes three main processes: (1) spiral winding a substrate to produce one or more of the individual components; (2) performing the required finishing operations on each component; and (3) assembling the finished components into a functioning dispenser package.

An example of a method of forming an internally threaded tube 400 is shown in FIG. 4. The method includes the steps of: spirally winding a first multi-ply material 402 to form an externally threaded multi-ply tube 400, wherein the first multi-ply material 400 includes one or more inner plies 404 and an outer ply 406, wherein the outer ply 406 is wider than the one or more inner plies 404, wherein subsequent windings of the inner plies 404 abut each other such that the outer ply 406 overlaps at each subsequent winding forming an external thread 408 whose width is determined by the difference in width between the one or more inner plies 404 and the outer ply 406 and whose height is determined by the thickness of the outer ply 406.

An example of a method of forming an internally threaded tube 500 is shown in FIG. 5. The method includes the steps of: spirally winding a second multi-ply material 502 to form an internally threaded multi-ply sleeve, wherein the second multi-ply material 502 includes an inner ply 504 and one or more outer plies 506, wherein the inner ply 504 is narrower than the one or more outer plies 506, wherein subsequent windings of the outer plies 506 abut each other such that the inner ply 504 leaves a gap at each subsequent winding forming an internal thread 508 whose width is determined by the difference in width between the inner ply 504 and the one or more outer plies 506 and whose depth is determined by the thickness of the inner ply 504.

Each of the tube 500 and the sleeve 400 is run at an angle that is consistent throughout the process to form a cooperating thread pitch. The tube 500 and the sleeve 400 are wound using the same base ply widths to create a common or sufficiently similar thread pitch. In an embodiment, the first multi-ply material 402 and/or the second multi-ply materials 502 may comprise a paperboard material.

For example, as shown in FIG. 4, as the multi-ply paper composition 402 is wrapped around a mandrel 420, at least one of the plies may be wider or narrower to form the threading 408, 116. In an embodiment, the sleeve 400 and tube 500 can be made using a multi-ply paper substrate in which one or more plies are equal to the basis width, which is roughly equivalent to the width of the winding belt. Each multi-ply paper substrate must include at least a single paper ply that is larger than the basis width (for creating the male thread) or narrower than the basis width (for creating the female thread). The width of the plies used to create the male and female threading can be chosen such that their proportions compensate for the thickness of the paper and enable the male threading to fit into the female threading. In a further embodiment, the tube 500 may be made from a single ply overlapping itself as it is wound about the mandrel 520.

FIG. 4 illustrates a process for making an outer threaded tube 400 by winding a multi-ply paperboard structure 402 around a mandrel 420. For example, an externally threaded paper tube 400 is created by using a wider top layer 406 in a multi-ply construction to create an overlap that forms the exterior male thread. For example, a tube 400 having an externally threaded surface may be created using a three-ply construction in which the top ply is wider than the two inner plies. In one example of such a construction, PLY 404*a* and PLY 404*b* are the inner plies and the PLY 406 is the top ply. In this example, PLY 404*a* and PLY 404*b* may each be 0.75" wide, while PLY 406 is 0.85" wide. Winding the top ply (0.85" wide) at the same pitch as each of the bottom two plies (each 0.75" wide) so that subsequent windings abut without overlap creates an approximately 0.1" overlap on the outside surface of the finished tube. The wider-than-basis-width paper on the top ply of the tube component creates a raised ridge along the outer diameter where the paper overlaps itself, forming a tube with an exterior male thread.

The height of the exterior male thread 406 may be a function of the thickness of the top ply. As an example, PLY 404*a* and PLY 404*b* may each be 0.008" thick and PLY 406 may be 0.014" thick. In such an example, the exterior male thread would be 0.014" high.

Referring to FIG. 5, an internally threaded sleeve 500 is created by using a narrower bottom layer in a multi-ply construction to create a gap that forms the interior female thread 508, 114. For example, a sleeve 500 having an internally threaded surface may be created using a four-ply construction in which the bottom PLY 504 is a narrower width than the three outer plies 506*a*, 506*b*, and 506*c*. In one example of such a construction, PLY 504 is the bottom (most interior) ply and the PLY 506*a*, PLY 506*b*, and PLY 506*c* are the outer plies. In this example, PLY 504 may be 0.67" wide, while PLY 506*a*, PLY 506*b*, and PLY 506*c* are each 0.75" wide. Winding the bottom ply (0.67" wide) at the same pitch as each of the top plies (each 0.75" wide) so that subsequent windings abut without overlap creates an approximately 0.1" gap on the inside surface of the finished tube. The narrower-than-basis-width paper on the bottom ply of the sleeve 500 creates a groove 508 along the inner diameter where the paper underlaps itself, forming a sleeve with an interior female thread. In another embodiment the thread 508 may be formed using any number of layers that includes at least two or more plies. For example, either or both of the tube 400 and sleeve 500 may be made from a two-ply construction. In another example, either the tube 400 or sleeve 500 may be made from a six-ply construction. In a further example, tube 400 may be made from a single ply overlapping atop itself. In this embodiment, the overlapped portion may be glued.

The depth of the interior female thread 508 is a function of the thickness of the bottom ply 504. Using the example in the preceding paragraph, PLY 504 and PLY 506*a* may each be 0.014" thick and PLY 506*b* and PLY 506*c* may each be 0.008" thick. In such an example, the interior female thread would be 0.014" deep.

In order to facilitate cooperation between the sleeve 102 and tube 104, each must be wound such that the resulting thread pitch matches between the two components. In an example, the winding mandrel 420, 520 about which the tubes are wound determines the inner diameter of each tube 104 or sleeve 102.

Using the process described above, the resulting tube 400 includes threads 408 that are a solid substrate, which cannot be easily collapsed or worn down over time during use. Properly constructed, the threads fit effortlessly into the sleeve 500 which includes a consistent, hard-edge channel 508 (created by the thickness of the bottom paper ply itself) to promote solid tracking and low-friction turning. The thicker the thread-creation plies are, the deeper the threads can engage with the plies, which results in a more robust mechanism. Further, the closeness in size of the contact diameters of each sleeve and tube component can be less critical, as a thicker ply affords more thread mating depth by design. It is contemplated that a paper caliper for the ply can be 0.012-0.016 inches to create significant thread thickness without imparting excess rigidity or spring-back in the ply as the tube is spirally wound, which makes adhesion more difficult and can result in "checking" or minute folds and breaks in the surface of the paper.

It is contemplated a wide range of substrates can be used to produce the components of the dispenser device 100, 200, 300. However, it is understood that the descriptions provided herein are particularly well-suited for creating a mechanism made from a paper or similar fiber substrate. For practical purposes, it is useful to use a substrate material that allows the product dispensed from the device to be contained and dispensed (and ideally, but not necessarily, filled into the package in a liquid state) without significant adhesion between the product and tube wall. Such adhesion may adversely impact the dispensing of the product or inhibit the smooth movement of the tube within the sleeve. Ideally, the substrate used has a high resistance to grease, oil, and wax (typically measured and conveyed as a numerical "kit" value by a paper mill) to be compatible with the widest range of products, thereby reducing the risk of the product binding to the paper substrate used to create the sleeve.

The manufacturing process should also take into consideration proper clearances and thread engagement between the mechanical components of the device 100. This includes controlling the size of the winding mandrels 420, 520 that determine the internal diameter of the sleeve 102 and tube 104, as well as controlling the caliper of each substrate ply that makes up the respective finished wall thicknesses of the sleeve 102 and tube 104. For example, the difference between the outside diameter of the tube 104 and the internal diameter of the sleeve 102 may be small to promote engagement while requiring minimal input force to operate the mechanism. For example, a 0.003-0.007 inches differential has been shown to be particularly advantageous to allow for manufacturing variation, and shrinkage and expansion with changes in relative humidity, for a paper-based substrate.

Controlling the slit width and cut width tolerance of the paper substrate to be put across the spiral winder to build the tube walls can help to ensure the threads on the tube and sleeve have a nearly identical pitch, which is particularly important as any significant pitch discrepancy between the two parts can cause the mechanism to bind and not move smoothly. The "basis width," or the width of the paper upon which the spiral winder's belt angle is set to result in minimal ply gap for the body of the tube of the tube and sleeve, can be the same for both the tube and the sleeve.

Although primarily described above with respect to the use of an overlapping and underlapping winding process, the threads of the sleeve 102 and tube 104 can be created by any method capable of producing engagement between the two components.

In the primary example provided herein, the production method builds up a threaded section of a first component along a narrow, spiraling path to mate into a groove or depression of similar width and depth on the companion component. For example, an inner surface of the sleeve 102 is formed with female threads (i.e., a continuous spiral groove) that receive male threads (i.e., a continuous raised spiral formation) on the outer surface of the tube 104.

Although the primary manufacturing methods cost-effectively enable the threading to be created in-line by the spiral winding process, alternatively the threads can be added in a secondary process, if deemed preferable. In an example, the threading can be formed by embossing a channel into one component part (e.g., sleeve) and debossing a cooperating ridge one into the companion component part (e.g., tube). This can be done, for example, as the substrate spirally winds across the forming mandrels to form each tube.

The assembled components form a package that is ready for filling with liquid or pre-formed solid product and stays in the retracted position until opened by the end user.

It should be noted that various changes and modifications to the presently preferred embodiments described herein will be apparent to those skilled in the art. Such changes and modifications may be made without departing from the spirit and scope of the present invention and without diminishing its attendant advantages.

What is claimed is:

1. A retractable dispenser device comprising:

an externally threaded tube comprising a spiral wound first ply material, wherein the first ply material includes at least one ply, wherein windings of a single ply of the first ply material overlaps itself at each subsequent winding forming an external thread whose width is determined by the amount of overlap and whose height is determined by the thickness of the single ply; and an internally threaded multi-ply sleeve comprising a spiral wound second multi-ply material, wherein the second multi-ply material includes an inner ply and one or more outer plies, wherein the inner ply is narrower than the one or more outer plies, wherein subsequent windings of the outer plies abut each other such that the inner ply leaves a gap at each subsequent winding forming an internal thread whose width is determined the difference in width between the one or more outer plies and the inner ply and whose depth is determined by the thickness of the inner ply;

wherein each of the tube and the sleeve are each wound at a consistent angle; and wherein the external thread of the tube and the internal thread of the sleeve form a cooperating thread pitch.

2. The retractable dispenser device of claim 1, wherein the externally threaded tube comprises a spiral wound first multi-ply material, wherein the first multi-ply material includes one or more inner plies and an outer ply, wherein the outer ply is wider than the one or more inner plies, wherein subsequent windings of the inner plies abut each other such that the outer ply overlaps at each subsequent winding forming an external thread whose width is determined by the difference in width between the one or more inner plies and the outer ply and whose height is determined by the thickness of the outer ply.

3. The retractable dispenser device of claim 1, wherein the first material comprises a paperboard material.

4. The retractable dispenser device of claim 1, wherein the second multi-ply material comprises a paperboard material.

5. The retractable dispenser device of claim 1, further comprising a stem located within the tube.

6. The retractable dispenser device of claim 5, wherein the stem is affixed to the tube.

7. The retractable dispenser device of claim 6, further comprising a base affixed to the stem.

8. The retractable dispenser device of claim 7, wherein the base includes two or more windows providing tactile access to the tube.

9. The retractable dispenser device of claim 7, further comprising a removeable cap that cooperates with the base to enclose the tube and sleeve.

10. The retractable dispenser device of claim 9, wherein:

the base surrounds at least a portion of an outer surface of the sleeve;

the first multi-ply material and the second multi-ply material are each paperboard; and twisting the tube in a first rotational direction advances a material supported on the stem in a first axial direction relative to the sleeve and twisting the tube in a second rotational direction opposite the first rotational direction advances the material supported on the step in a second axial direction relative to the sleeve, wherein the second axial direction is opposite the first axial direction.

11. The retractable dispenser device of claim 1, wherein the tube further comprises a support surface spanning an interior diameter of the tube.

12. The retractable dispenser device of claim 11, further comprising a base affixed to the tube.

13. The retractable dispenser device of claim 12, wherein the base includes two or more windows providing tactile access to the tube.

14. The retractable dispenser device of claim 12, further comprising a removable cap that cooperates with the base to enclose the tube.

15. The retractable dispenser device of claim 14, wherein:

the base surrounds at least a portion of an outer surface of the sleeve;

the first multi-ply material and the second multi-ply material are each paperboard; and twisting the tube in a first rotational direction advances a material supported on the stem in a first axial direction relative to the sleeve and twisting the tube in a second rotational direction opposite the first rotational direction advances the material supported on the step in a second axial direction relative to the sleeve, wherein the second axial direction is opposite the first axial direction.

16. A method of forming an internally threaded tube and a corresponding externally threaded tube comprising the steps of:

spirally winding a first material to form an externally threaded tube, wherein the first material includes at least one ply, wherein windings of a single ply of the first material overlaps itself at each subsequent winding forming an external thread whose width is determined by the amount of overlap and whose height is determined by the thickness of the single ply; and spirally winding a second multi-ply material to form an internally threaded multi-ply sleeve, wherein the second multi-ply material includes an inner ply and one or more outer plies, wherein the inner ply is narrower than the one or more outer plies, wherein subsequent windings of the outer plies abut each other such that the inner ply leaves a gap at each subsequent winding forming an internal thread whose width is determined by the difference in width between the inner ply and the one or more outer plies and whose depth is determined by the thickness of the inner ply;

wherein each of the tube and the sleeve are each wound at a consistent angle; and wherein the external thread of the tube and the internal thread of the sleeve form a cooperating thread pitch.

17. The method of claim 16, wherein the step of spirally winding a first material comprises the step of spirally winding a first multi-ply material to form an externally threaded multi-ply tube, wherein the first multi-ply material includes one or more inner plies and an outer ply, wherein the outer ply is wider than the one or more inner plies, wherein subsequent windings of the inner plies abut each other such that the outer ply overlaps at each subsequent winding forming an external thread whose width is determined by the difference in width between the one or more inner plies and the outer ply and whose height is determined by the thickness of the outer ply.

18. The method of claim 16, wherein the first material comprises a paperboard material.

19. The method of claim 16, wherein the second multi-ply material comprises a paperboard material.

20. The method of claim 16, wherein a difference between an exterior diameter of the tube and an internal diameter of the sleeve is in the range of 0.003-0.007 inches.

21. The method of claim 16, further comprising the step of forming a top edge of the tube inward to form a lip.

22. The method of claim 16, further comprising the step of forming a bottom edge of the sleeve inward to create a stop.

* * * * *